US007273207B2

(12) United States Patent
Studer

(10) Patent No.: US 7,273,207 B2
(45) Date of Patent: Sep. 25, 2007

(54) BI-DIRECTIONAL WINCH

(76) Inventor: Ronald M. Studer, 1820 E. Mansfield St., Bucyrus, OH (US) 44820

( * ) Notice: Subject to any disclaimer, the term of this patent is extended or adjusted under 35 U.S.C. 154(b) by 0 days.

(21) Appl. No.: 11/366,134

(22) Filed: Mar. 2, 2006

(65) Prior Publication Data

US 2006/0197073 A1 Sep. 7, 2006

Related U.S. Application Data

(60) Provisional application No. 60/657,899, filed on Mar. 2, 2005.

(51) Int. Cl.
*B66D 1/26* (2006.01)

(52) U.S. Cl. ..... 254/278; 254/298; 254/317; 254/323; 254/345; 254/346

(58) Field of Classification Search ..... 254/278, 254/294, 295, 298, 299, 304, 317, 323, 345, 254/346
See application file for complete search history.

(56) References Cited

U.S. PATENT DOCUMENTS 813,211 A * 2/1906 Jacobs ..... 254/312
3,003,585 A * 10/1961 Andersson ..... 187/257
3,618,898 A * 11/1971 Notestine ..... 254/343
3,654,869 A * 4/1972 Lehrer ..... 104/114
4,033,553 A * 7/1977 Sugimoto ..... 254/297
4,284,265 A * 8/1981 Morrow, Sr. ..... 254/317
4,607,142 A * 8/1986 Martin ..... 379/406.04
4,683,994 A * 8/1987 Weisenfelder ..... 192/3.61
4,946,642 A * 8/1990 Yoshinaga et al. ..... 376/260
5,678,805 A * 10/1997 Moser et al. ..... 254/279
6,105,938 A * 8/2000 Koida ..... 254/278

FOREIGN PATENT DOCUMENTS

JP 2004149277 A * 5/2004 ..... 254/323

* cited by examiner

*Primary Examiner*—Emmanuel M Marcelo
(74) *Attorney, Agent, or Firm*—Pearne & Gordon LLP

(57) ABSTRACT

A winch includes a first cable reel and a second cable reel. A driveshaft rotates the first cable reel and the second cable reel. The driveshaft is moveable along an axis of rotation between a first position and a second position. The driveshaft operationally engages the first cable reel when in the first position and operationally engages the second cable reel when in the second position.

31 Claims, 6 Drawing Sheets

BI-DIRECTIONAL WINCH

CROSS-REFERENCE TO RELATED APPLICATIONS

Benefit of U.S. Provisional Patent Application Ser. No. 60/657,899, filed Mar. 2, 2005, is hereby claimed and the disclosure incorporated herein by reference. The disclosures of U.S. patent application Ser. Nos. 11/036,681 and 11/079,430 are incorporated herein by reference.

BACKGROUND OF THE INVENTION

1. Field of the Invention

This application relates generally to a bi-directional winch system. More specifically, this application relates to a bi-directional winch system suitable for mounting on a mobile device, for example, on a truck bed.

2. Description of Related Art

Vehicle mounted winch systems, for example, winch systems for mounting to the front of a vehicle, are known to the art. However, such systems may not be easily employed to provide a pulling force at the rear of a vehicle. Likewise, a rear mounted winch system may not be easily employed to provide a pulling force at the front of a vehicle. The need exists for an easy-to-use vehicle mounted winch system that is capable of providing a pulling force at either the front and/or rear of a vehicle.

BRIEF SUMMARY OF THE INVENTION

In accordance with one aspect of the present invention, provided is a winch system, which includes a first cable reel and a second cable reel. A driveshaft rotates the first cable reel and the second cable reel. The driveshaft is moveable along an axis of rotation between a first position and a second position. The driveshaft operationally engages the first cable reel when in the first position and operationally engages the second cable reel when in the second position.

In accordance with another aspect of the present invention, provided is a winch system, which includes a first cable reel and a second cable reel. A first cable reel bracket supports the first cable reel and a second cable reel bracket supports the second cable reel. A first gearbox operationally engages the first cable reel. A second gearbox operationally engages the second cable reel. A winch motor powers the first gearbox and the second gearbox.

In accordance with another aspect of the present invention, provided is a vehicle-mounted winch system, which includes a gearbox and a motor for powering the gearbox. A driveshaft is driven by an output of the gearbox. The driveshaft is moveable along an axis of rotation between a first position and a second position. A shift lever moves the driveshaft between the first position and the second position. An extension collar connects the output of the gearbox to the driveshaft. The driveshaft is movable within the extension collar along the axis of rotation. The winch system also includes a first cable reel, a second cable reel, a first cable reel bracket for supporting the first cable reel, and a second cable reel bracket for supporting the second cable reel. A gear, which is mounted on the driveshaft between the first cable reel and the second cable reel, engages the first cable reel when the driveshaft is in the first position and engages the second cable reel when the driveshaft is in the second position. A first windable support extends from the first cable reel and a second windable support extends from the second cable reel. Rotating the first cable reel in a first direction causes the first windable support to wind around the first cable reel and rotating the second cable reel in the first direction causes the second windable support to wind around the second cable reel. The winch system also includes an enclosure, wherein the bi-directional winch system is located at least partially within the enclosure.

In accordance with another aspect of the present invention, provided is a winch system, which includes a first spool including a first windable support, a second spool including a second windable support, and a motor. The winch system further includes means for operationally engaging and disengaging the first spool with the motor and means for operationally engaging the second spool with the motor.

DETAILED DESCRIPTION OF THE INVENTION

The invention described herein is a winch system, for example, a bi-directional winch system for providing pulling forces in two directions, such as in a forward and/or rear direction. If desired, the bi-directional winch system can be mounted to a base, which could provide for easy installation of the system. For example, the system components could be pre-installed on the base and the base could be installed at a desired location, rather than individual system components. The system can be installed within a building or it can be installed on a mobile device. For example, the system can be mounted to a truck bed, or behind the seats in a truck cab, or between the frame rails beneath the truck bed or cab.

Generally, the winch system includes a driveshaft and first and second cable reels or spools that are turned by the driveshaft. The first and second cable reels are configured to provide forward and rear pulling forces, respectively, when turned by the drive shaft. When the driveshaft is shifted from engaging one cable reel to another, a pulling force in the opposite direction can be achieved. Alternatively, both cable reels could be engaged simultaneously, providing pulling forces in two directions at once.

Figure 1:
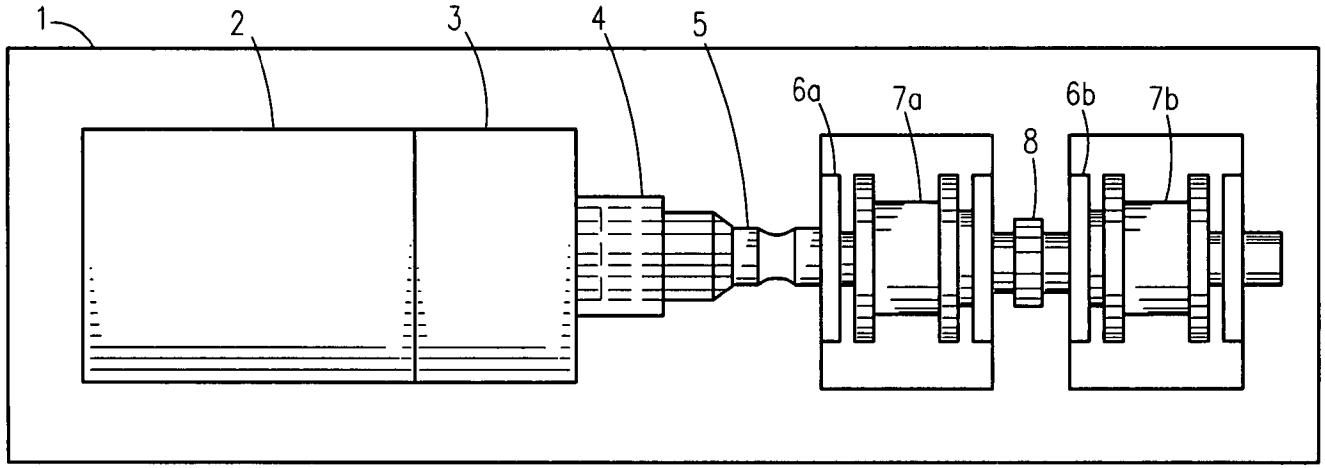
FIG. 1 is a plan view of a bi-directional winch system.
Figure 2:
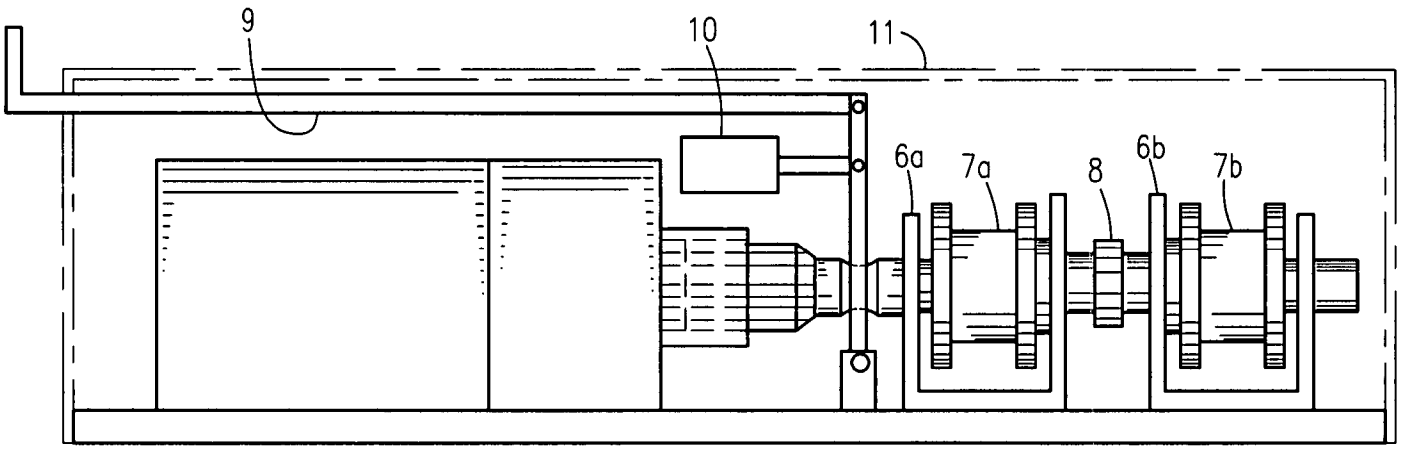
FIG. 2 is a front elevation view of the system shown in FIG. 1.

FIGS. 1 and 2 show an embodiment of the bi-directional winch system. The system includes a base plate 1 to which system components are mounted. The system can be installed by mounting the base plate 1 to a vehicle, for example, within the bed of a truck. The base plate 1 can be permanently installed within the vehicle, for example, by welding the base to the bed of the truck, or the base plate 1 can be removably installed, for example, by screwing or clamping the base plate 1 to the bed of the truck.

The system further includes a winch motor 2 and a gearbox 3. The winch motor 2 could employ, for example, an electric motor. Alternatively, the winch motor 2 could employ an internal combustion engine, or could include a pneumatic or hydraulic device, for example. The gearbox 3 is driven by the winch motor 2. Alternatively, the gearbox 3 could be directly driven by, for example, a hand crank, a ratcheting wrench, or a drill, such as a cordless drill.

An extension collar 4 connects the gearbox 3 to a driveshaft 5. The driveshaft 5 has splines that fit into corresponding slots within the extension collar 4. The winch motor 2 turns the gearbox 3, which causes the extension collar 4 to turn. The extension collar 4 causes the driveshaft 5 to rotate by engaging the driveshaft's 5 splines. The driveshaft 5 is able to slide laterally within the extension collar 4, generally along the driveshaft's axis of rotation. As will be described further below, by sliding the driveshaft 5 laterally within the extension collar 4, either of two cable reels can be engaged and driven.

The system includes a first cable reel bracket 6*a* and a second cable reel bracket 6*b* for supporting a first cable reel 7*a* and a second cable reel 7*b*, respectively. Additionally, the cable reel brackets 6*a*, 6*b* can include bearings for supporting the driveshaft 5. The driveshaft 5 passes through the center of the cable reel brackets 6*a*, 6*b* and cable reels 7*a*, 7*b*. The driveshaft includes an engagement gear 8 located between the cable reels 7*a*, 7*b* and brackets 6*a*, 6*b*. When the driveshaft 5 is slid laterally within the extension collar 4, the engagement gear moves laterally between the cable reel brackets 6*a*, 6*b* and cable reels 7*a*, 7*b* and is capable of engaging either of the cable reels 7*a*, 7*b*. When the driveshaft 5 turns and the engagement gear 8 is engaged with a cable reel 7*a*, 7*b*, it causes the cable reel 7*a*, 7*b* to turn. When turned in one direction, for example, clockwise, a cable reel 7*a*, 7*b* either provides a forward or rear pull by winding a cable. When the cable reels 7*a*, 7*b* are configured to provide pulls in opposite directions when turned in one direction, forward and rear pulling force can be achieved by merely moving the engagement gear 8 between the cable reel brackets 6*a*, 6*b*.

In an embodiment, the engagement gear 8 is capable of engaging either one of the cable reels 7*a*, 7*b* individually or simultaneously. When the driveshaft 5 is in a first position, the engagement gear 8 engages the first cable reel 7*a* and not the second cable reel 7*b*. When the driveshaft 5 is in a second, laterally extended position, the engagement gear 8 engages both of the first cable reel 7*a*and the second cable reel 7*b* simultaneously. When the driveshaft 5 is in a third, further laterally extended position, the engagement gear 8 engages the second cable reel 7*b* and not the first cable reel 7*a*.

Sliding of the driveshaft 5 within the extension collar 4 and the corresponding movement of the engagement gear 8 could be achieved through a manual shifting lever 9 which engages the driveshaft 5. Alternatively, a powered shifting device 10, for example, an electric motor, solenoid or other driven piston, could be employed. Use of a powered shifting device 10 could allow for push-button shifting by an operator. Still alternatively, the manual shifting lever 9 could be used in combination with the powered shifting device 10, providing manual operation should the powered shifting device 10 fail. The manual shifting lever 9 or powered shifting device 10 can include a fork for engaging a groove on the driveshaft or extension on the driveshaft having a groove.

The bi-directional winch system could be enclosed by a cover 11 which connects to the base plate. The cover 11 would include openings for winch cables and, if necessary, electrical wires and the manual shifting lever 9.

Figure 3:
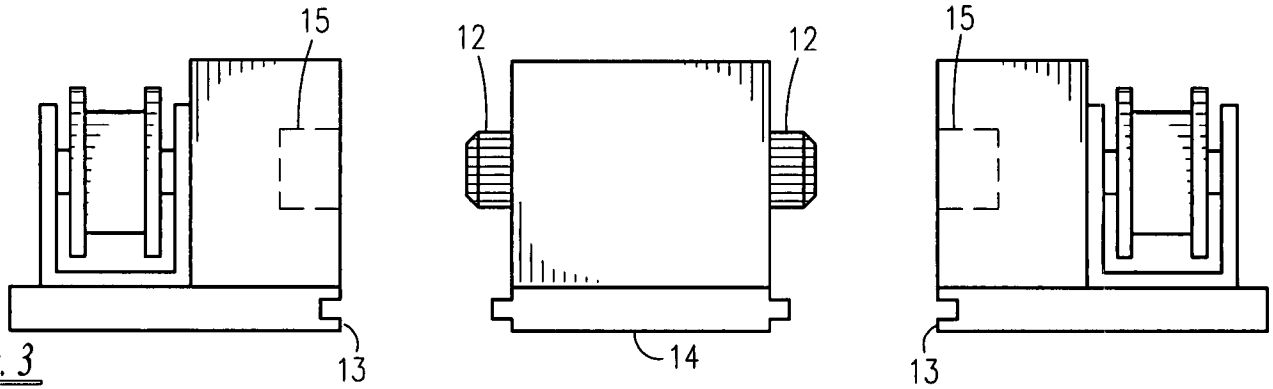
FIG. 3 is a front elevation view of a bi-directional winch system.

FIG. 3 shows an embodiment which lacks a driveshaft. The winch motor 2 is located between the cable reel brackets and is moveable, for example, able to be slid (slidable), between gear boxes 40*a*, 40*b* connected to the cable reel brackets. A splined extension 12 from the gear motor 2 engages a hollow gear cavity 15 on each gearbox 40*a*, 40*b*. The gearboxes 40*a*, 40*b* can include planetary or worm gears to prevent cable slippage when the motor is disengaged. Alternatively, the gearboxes 40*a*, 40*b* could be fixed in place when not in use by other methods, for example, by pinning or blocking in place.

In a further embodiment, each gearbox 40*a*, 40*b* does not have a hollow gear cavity 15, for engaging the splined extension 12. Instead, each gearbox 40*a*, 40*b* has an extension collar for achieving the same purpose. Still further, the gearboxes 40*a*, 40*b* could be mounted to and moveable with the motor for engaging the cable reel brackets.

In an embodiment in which the motor 2 is slidable between gearboxes connected to the cable reel brackets, a motor base plate 14 having an engaging portion, for example, a tongue, tenon, or dowel, can be used to engage a corresponding base plate 13 beneath the gearbox having a receiving portion, for example, a groove, mortise, or drilled hole.

Figure 4:
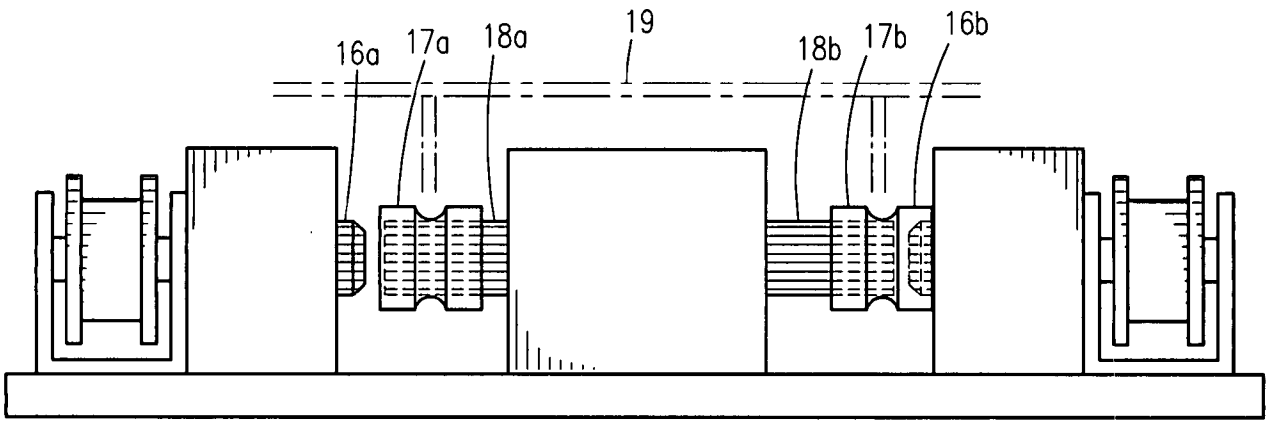
FIG. 4 is a front elevation view of a bi-directional winch system.

FIG. 4 shows an embodiment of the bi-directional winch system in which the position of the cable reels, gearboxes, and motor are fixed, and the motor is located between the cable reel brackets and gearboxes. Shifting from one cable reel to the other is achieved by moving sliding shifting collars 17*a*, 17*b* onto and off of corresponding splined extensions 16*a*, 16*b* from the gearboxes. The splined gearbox extensions 16*a*, 16*b* engage internal grooves in the shifting collars 17*a*, 17*b*. Splined motor extensions 18*a*, 18*b* also engage the internal grooves in the shifting collars 17*a*, 17*b*. The shifting collars 17*a*, 17*b* can move simultaneously or individually. A shifting device 19, which is shown schematically in dashed lines, can be used to move the shifting collars 17*a*, 17*b*. The shifting device can be manually operated, power driven, or operated by a combined manual and powered system.

Figure 7:
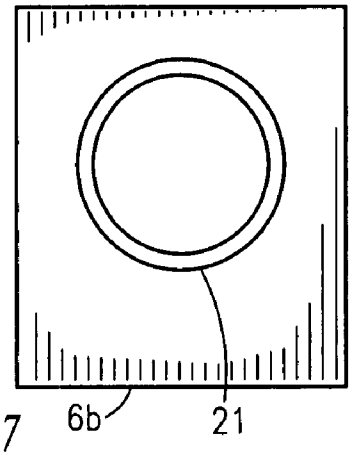
FIG. 7 is a side elevation view of a cable reel bracket.
Figure 6:
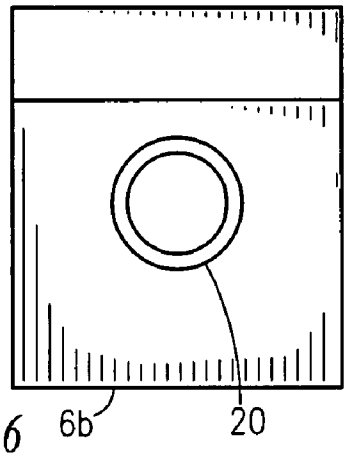
FIG. 6 is a side elevation view of a cable reel bracket.
Figure 5:
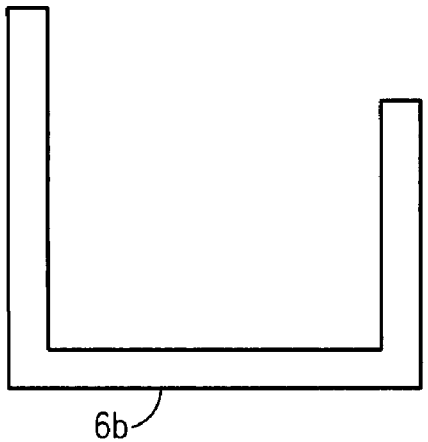
FIG. 5 is a front elevation view of a cable reel bracket.

A cable reel bracket 6*b* can be seen in FIGS. 5, 6, and 7. FIG. 5 shows a front elevation view of the cable reel bracket 6*b*. The right side of the cable reel bracket 6*b* is shown in FIG. 6. The right side includes a driveshaft shaft bearing 20 for supporting the driveshaft and allowing it to slide through when shifting occurs, that is, when the driveshaft is slid within the extension collar and the engagement gear is moved from one cable reel to the other. The left side of the cable reel bracket 6*b* is shown in FIG. 7. The left side includes a cable reel bearing 21 for supporting an enlarged end of a cable reel.

Figure 10:
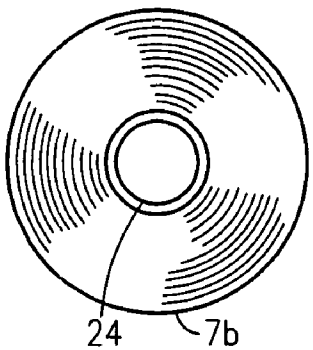
FIG. 10 is a side elevation view of a cable reel.
Figure 9:
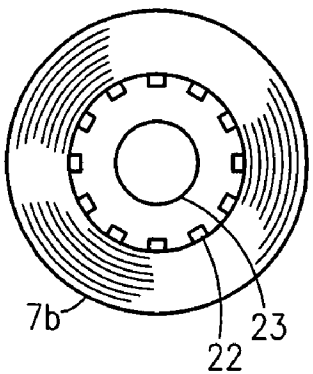
FIG. 9 is a side elevation view of a cable reel.
Figure 8:
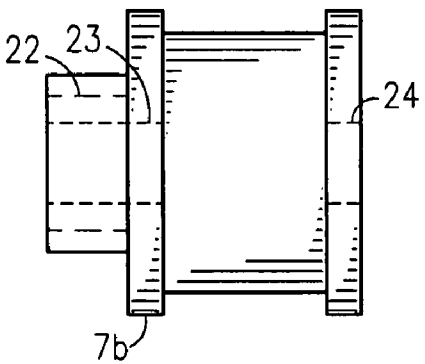
FIG. 8 is a front elevation view of a cable reel.

A cable reel 7*b* can be seen in FIGS. 8, 9, 10. A front elevation view of the cable reel 7*b* is shown in FIG. 8, while the left and right end views are shown in FIGS. 9 and 10, respectively. The cable reel 7*b* includes an enlarged end that houses a hollow gear 22 and a first cable reel bearing 23. An additional end of the cable reel 7*b* includes a second cable reel bearing 24. The hollow gear 22 engages the engagement gear 8, while the first cable reel bearing 23 and second cable reel bearing 24 allow the driveshaft 5 to slide through.

Figure 11:
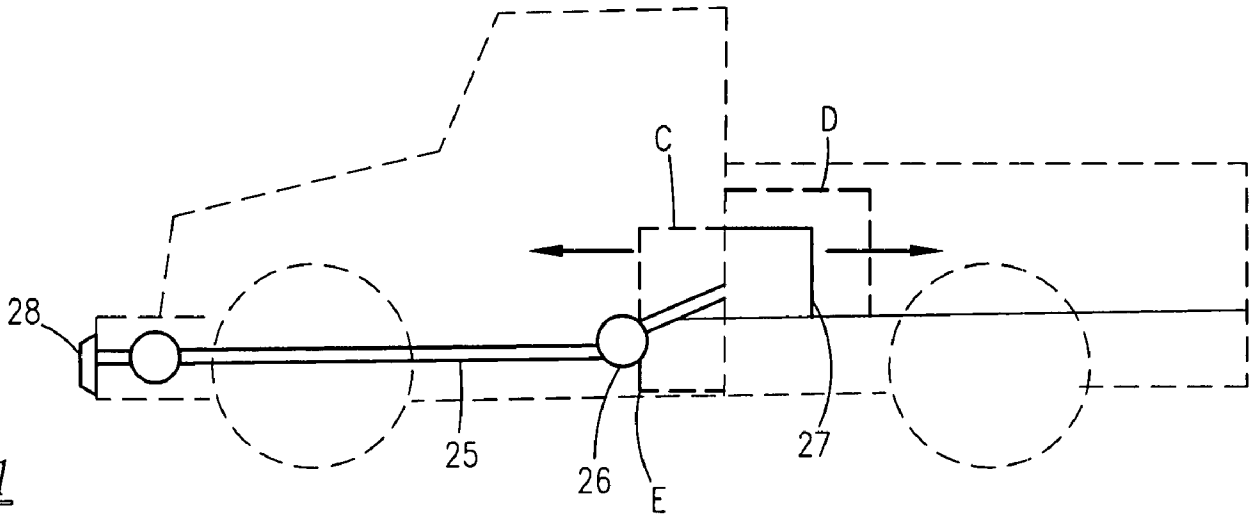
FIG. 11 is a side elevation view of a pickup truck having a bi-directional winch system.

FIG. 11 shows a pickup truck having a covered bi-directional winch system 27. Arrows indicate forward and rear directions. The system can be installed within an additional enclosure, for example a truck bed mounted toolbox (indicated as "D" in FIG. 11), for added security and compactness. Alternatively, the system can be installed within the interior of a vehicle, for example, in the truck cab (indicated as "C" in FIG. 11). Still alternatively, the system could be installed between the frame rails of the truck (indicated as "E" in FIG. 11). The system could be mounted to a variety of different vehicles and in a variety of different locations, for example, in a trunk. The system could also be mounted to a trailer. The system could also employ a variety of cables or other windable supports that are capable of being wound around a cable reel. In an embodiment, armored cable is utilized as the windable support. A windable support can be spooled on, that is, wound on or off of, a cable reel.

The truck shown in FIG. 11 includes a bumper cover 28 for housing a hook that would be attached to the windable support. The bumper cover 28 would provide for compact or low-profile storage of the hook. When employed, the hook would be withdrawn from the bumper cover and secured to an object to be subjected to a pulling force. By turning the cable reel to which the hook is joined through its windable support, the windable support would be wound and a pulling force generated. A cover at the rear of the vehicle, similar to the pictured bumper cover 28, could also be provided.

Windable supports could be routed along the vehicle through tubes 25. If desired, pulleys 26 could be attached to the vehicle to facilitate routing of the windable supports. The pulleys 26 could be either open or covered. In addition to facilitating the routing of the windable supports, the pulleys 26 could provide for the generation of pulling forces in a variety of directions. For example, pulleys 26 could be mounted along the vehicle to change a pulling force directed toward the rear of a vehicle to a pulling force directed toward the side of a vehicle.

Mounting the bi-directional winch within an enclosure or beneath a cover could provide for an aesthetically pleasing system and deter or secure against theft. An enclosure or cover could help keep dirt and other foreign matter from coating the system and possibly affecting its operation.

Figure 13:
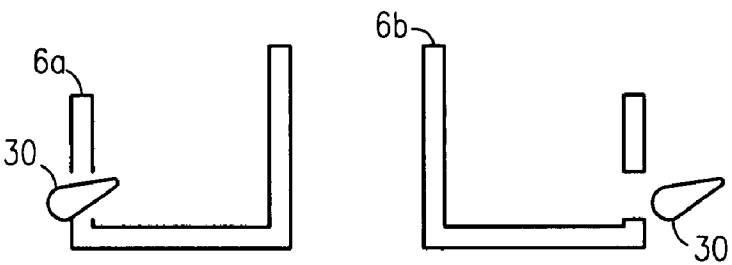
FIG. 13 is a front elevation view of two cable reel brackets having locking cams.
Figure 12:
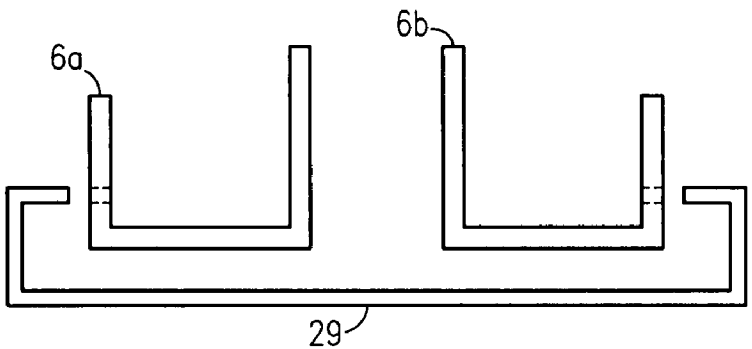
FIG. 12 is a front elevation view of two cable reel brackets having a locking bar.

A locking bar 29 is shown in FIG. 12. The locking bar 29 is laterally shiftable and capable of engaging either cable reel bracket 6*a*, 6*b*. When engaged with a cable bracket 6*a*, 6*b*, the locking bar 29 prevents a cable reel from turning. The locking bar 29 could be attached to or operated in conjunction with the manual shifting lever 9 or powered shifting device 10 shown in FIG. 2 to prevent the turning of the cable reel not currently engaged. FIG. 13 shows a cam lock 30 for preventing a cable reel from turning as an alternative to the locking bar 29.

Figure 14:
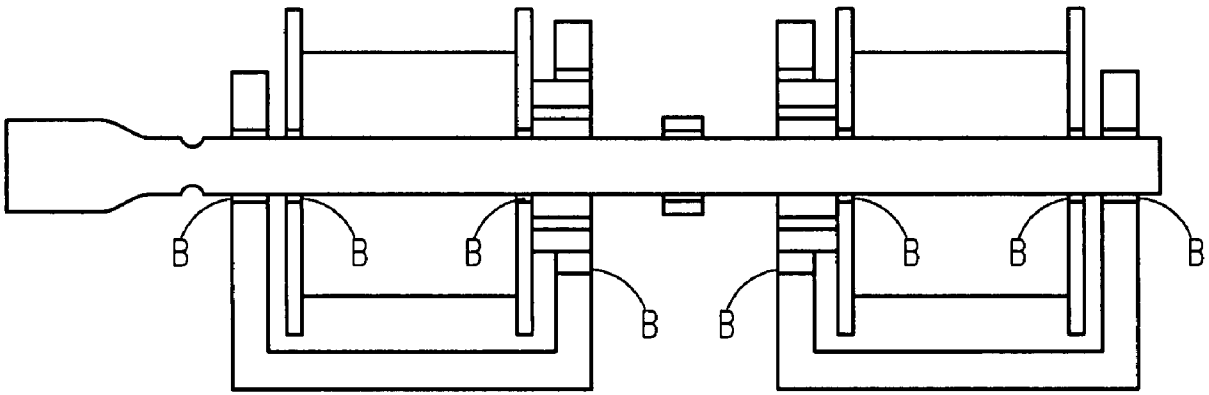
FIG. 14 is a front elevation view of a bi-directional winch system.

The bi-directional winch system shown in FIGS. 1 and 2 can be seen in FIG. 14. Various bearings included in the system are indicated by the letter "B."

Figure 15:
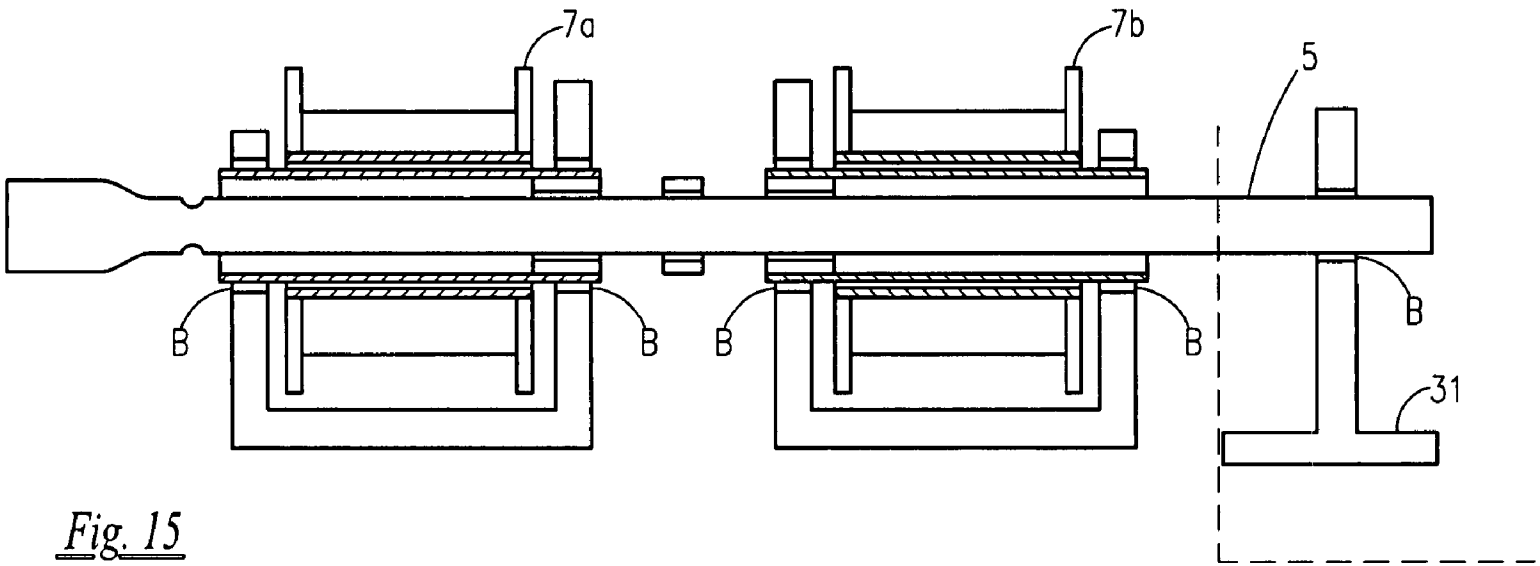
FIG. 15 is a front elevation view of a bi-directional winch system.

FIG. 15 shows an embodiment of the bi-directional winch system in which the cable reels 7*a*, 7*b* lack bearings. Bearings are indicated by the letter "B." The cable reels 7*a*, 7*b* utilize a tube over tube construction. An optional support base 31 for the driveshaft 5 can be included.

Figure 16:
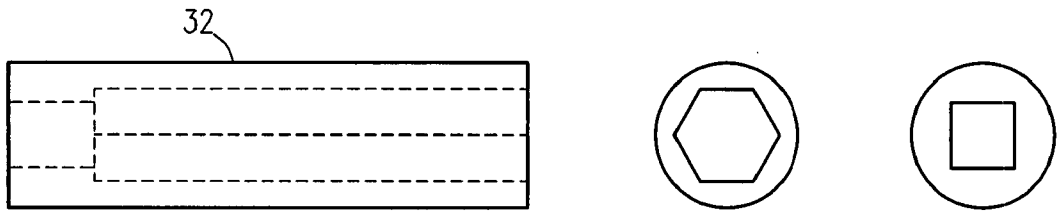
FIG. 16 shows a deep wall impact socket for use as an extension collar between a gearbox and driveshaft.
Figure 17:
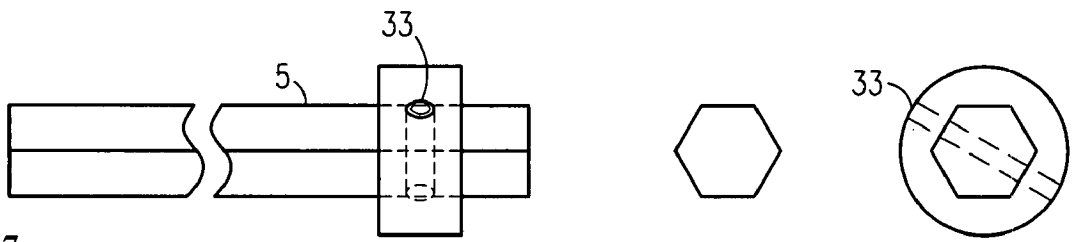
FIG. 17 shows a driveshaft.
Figure 18:
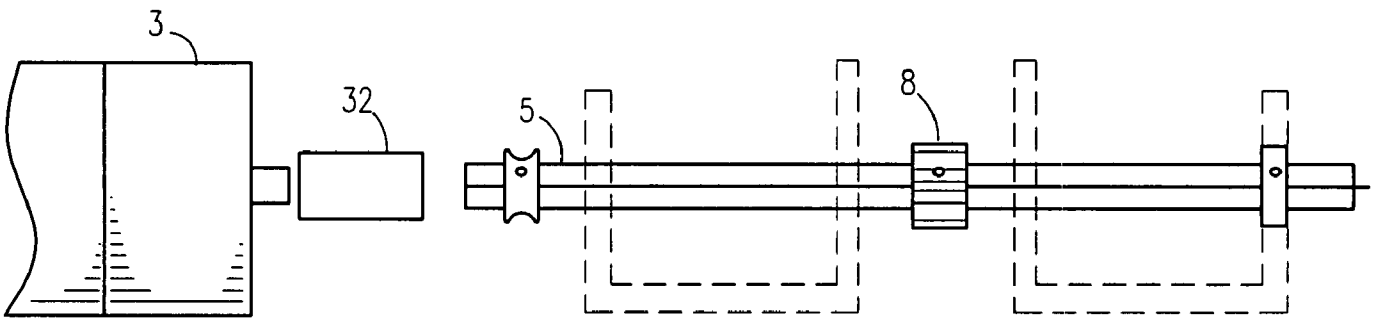
FIG. 18 a front elevation view showing a gearbox, impact socket extension collar, and driveshaft.

An embodiment of the bi-directional winch system can be seen in FIGS. 16, 17, and 18. In this embodiment, a deep wall impact socket 32 is provided for use as the extension collar. The square cavity of the socket 32 fits onto the squared shaft of the gearbox 3. The hexagonal cavity of the socket 32 fits onto the hexagonal driveshaft 5. The driveshaft 5 is able to slide laterally within the socket 32 for shifting between cable reels. Devices located on the driveshaft 5, for example, the engagement gear 8, can be secured to the driveshaft 5 by a pin 33 inserted partially or fully through the device and driveshaft 5.

It is desirable that bearings through which the driveshaft 5 passes engage the driveshaft loosely enough to allow the driveshaft 5 to slide back and forth through them. Examples of suitable bearings include, for example, ball bearings, roller bearings, and solid sleeve bearings.

Travel limiting devices, such as limit switches, torque switches, or the like can be included in an embodiment of the invention, to limit winding of a windable support around a cable reel. For example, a travel limiting device can prevent a windable support from completely winding around a cable reel. The travel limiting device could cause the winch motor to automatically stop rotating the cable reels when, for example, a predetermined amount of the windable support has been wound around a cable reel, a predetermined amount of windable support remains extended from a cable reel, or a predetermined torque is reached or exceeded. In the embodiment of FIG. 11, a travel limiting device can stop the retraction of the forward-pulling windable support when the hook reaches the bumper cover 28.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A winch system comprising:

a first cable reel;

a second cable reel;

a gearbox;

an extension collar; and a driveshaft for rotating the first cable reel and the second cable reel, wherein the extension collar connects the gearbox to the driveshaft, and wherein the driveshaft is moveable along an axis of rotation between a first position and a second position, and further wherein the driveshaft operationally engages the first cable reel when in the first position and operationally engages the second cable reel when in the second position.

2. The winch system as set forth in claim 1, further comprising an enclosure, wherein the winch system is located at least partially within the enclosure.

3. The winch system as set forth in claim 1, wherein the winch system is installed in a truck.

4. The winch system as set forth in claim 1, wherein the winch system is installed in a building.

5. The winch system as set forth in claim 1, further comprising a manual shift lever connected to the driveshaft for moving the driveshaft between the first position and the second position.

6. The winch system as set forth in claim 5, further comprising a base plate wherein the first cable reel, the second cable reel, the driveshaft, and the manual shift lever are supported by the base plate.

7. The winch system as set forth in claim 6, further comprising a cover connected to the base plate.

8. The winch system as set forth in claim 1, wherein the extension collar includes an impact socket.

9. The winch system as set forth in claim 1, further comprising a motor for driving the gearbox.

10. The winch system as set forth in claim 9, wherein the extension collar includes a socket.

11. The winch system as set forth in claim 9, further comprising:

a first cable reel bracket for supporting the first cable reel;

a second cable reel bracket for supporting the second cable reel; and an engagement gear connected to the driveshaft and capable of engaging either of the first cable reel and the second cable reel.

12. The winch system as set forth in claim 11, further comprising:

a first windable support extending from the first cable reel; and a second windable support extending from the second cable reel, wherein rotating the first cable reel in a first direction causes the first windable support to wind around the first cable reel and rotating the second cable reel in the first direction causes the second windable support to wind around the second cable reel.

13. The winch system as set forth in claim 11, further comprising a power shifting device for moving the driveshaft between the first position and the second position.

14. The winch system as set forth in claim 11, further comprising a locking bar capable of preventing rotation of at least one of the first cable reel and the second cable reel.

15. The winch system as set forth in claim 11 wherein the first cable reel bracket includes a first driveshaft bearing for supporting the driveshaft and a first cable reel bearing for supporting the first cable reel, and the second cable reel bracket includes a second driveshaft bearing for supporting the driveshaft and a second cable reel bearing for supporting the second cable reel.

16. The winch system as set forth in claim 11, wherein the first cable reel includes a first hollow gear for engaging the engagement gear and the second cable reel includes a second hollow gear for engaging the engagement gear.

17. The winch system as set forth in claim 11, further comprising:

a hook;

a bumper cover capable of housing the hook; and a windable support capable of joining the hook to one of the first cable reel and the second cable reel.

18. The winch system as set forth in claim 17, further comprising a tube through which the windable support is routed.

19. The winch system as set forth in claim 1, wherein the winch system is installed within a vehicle.

20. A winch system comprising:

a first cable reel;

a second cable reel;

a first cable reel bracket for supporting the first cable reel;

a second cable reel bracket for supporting the second cable reel;

a first gearbox for operationally engaging the first cable reel;

a second gearbox for operationally engaging the second cable reel; and a winch motor for powering the first gearbox and the second gearbox, wherein the winch motor is moveable between the first gearbox and the second gearbox.

21. The winch system as set forth in claim 20, wherein the first and second gearboxes include worm gears.

22. The winch system as set forth in claim 20, further comprising; a motor base plate having an engaging portion; and a gearbox base plate having a receiving portion for receiving the engaging portion.

23. A winch system comprising:

a first cable reel;

a second cable reel;

a first cable reel bracket for supporting the first cable reel;

a second cable reel bracket for supporting the second cable reel;

a first gearbox for operationally engaging the first cable reel;

a second gearbox for operationally engaging the second cable reel; and a winch motor for powering the first gearbox and the second gearbox, wherein the first gearbox and the second gearbox are connected to the winch motor and the winch motor is moveable between the first cable reel bracket and the second cable reel bracket.

24. A winch system comprising:

a first cable reel;

a second cable reel;

a first cable reel bracket for supporting the first cable reel, a second cable reel bracket for supporting the second cable reel;

a first gearbox for operationally engaging the first cable reel;

a second gearbox for operationally engaging the second cable reel;

a winch motor for powering the first gearbox and the second gearbox;

a first shifting collar;

a second shifting collar;

a first gearbox extension;

a second gearbox extension;

a first motor extension; and a second motor extension, wherein the first and second shifting collars are capable of sliding between and engaging the first and second gearbox extensions and the first and second motor extensions.

25. The winch system as set forth in claim 24, further comprising a shifting device capable of moving the first and second shifting collars.

26. A vehicle-mounted winch system comprising:

a gearbox;

a motor for powering the gearbox;

a driveshaft which is driven by an output of the gearbox, wherein the driveshaft is moveable along an axis of rotation between a first position and a second position;

a shift lever for moving the driveshaft between the first position and the second position;

an extension collar for connecting the output of the gearbox to the driveshaft, wherein the driveshaft is movable within the extension collar along the axis of rotation;

a first cable reel;

a second cable reel;

a first cable reel bracket for supporting the first cable reel;

a second cable reel bracket for supporting the second cable reel;

a gear which is mounted on the driveshaft between the first cable reel and the second cable reel for engaging the first cable reel when the driveshaft is in the first position and for engaging the second cable reel when the driveshaft is in the second position;

a first windable support extending from the first cable reel;

a second windable support extending from the second cable reel, wherein rotating the first cable reel in a first direction causes the first windable support to wind around the first cable reel and rotating the second cable reel in the first direction causes the second windable support to wind around the second cable reel; and an enclosure, wherein the winch system is located at least partially within the enclosure.

27. A winch system comprising:

a first spool including a first windable support;

a second spool including a second windable support;

a motor;

means for operationally engaging and disengaging the first spool with the motor; and means for operationally engaging the second spool with the motor, wherein said first spool and said second spool can be operationally engaged simultaneously.

28. The winch system of claim 27, wherein the means for operationally engaging and disengaging the first spool includes the means for operationally engaging the second spool.

29. The winch system of claim 27, wherein said first spool and said second spool can be operationally engaged alternately.

30. The winch system of claim 27, wherein said first windable support is arranged to pull objects from one direction when engaged with the motor and wherein said second windable support is arranged to pull objects from another direction when engaged with the motor.

31. A vehicle including said winch system of claim 27 installed thereon.

* * * * *